US010589955B2

(12) United States Patent
Arata

(10) Patent No.: US 10,589,955 B2
(45) Date of Patent: Mar. 17, 2020

(54) IMAGE FORMING APPARATUS, SORTING DEVICE, AND TRAY UNIT

(71) Applicant: KYOCERA Document Solutions Inc., Osaka (JP)

(72) Inventor: Tatsuro Arata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/120,476

(22) Filed: Sep. 4, 2018

(65) Prior Publication Data

US 2019/0077626 A1 Mar. 14, 2019

(30) Foreign Application Priority Data

Sep. 8, 2017 (JP) ..... 2017-173107

(51) Int. Cl.

*B65H 29/60* (2006.01)
*B65H 31/24* (2006.01)
*B65H 29/58* (2006.01)
*B65H 31/02* (2006.01)
(Continued)

(52) U.S. Cl.

CPC ..... *B65H 29/60* (2013.01); *B65H 29/58* (2013.01); *B65H 31/02* (2013.01); *B65H 31/20* (2013.01); *B65H 31/24* (2013.01); *B65H 39/11* (2013.01); *B65H 2402/31* (2013.01); *B65H 2404/6112* (2013.01); *B65H 2404/63* (2013.01); *B65H 2405/1114* (2013.01); *B65H 2405/11164* (2013.01); *B65H 2405/332* (2013.01); *B65H 2408/1121* (2013.01); *B65H 2801/06* (2013.01)

(58) Field of Classification Search

CPC ..... B65H 29/60; B65H 29/58; B65H 31/02; B65H 31/20; B65H 31/24; B65H 2408/1121; B65H 2405/332; B65H 2405/1114; B65H 2405/11164

See application file for complete search history.

(56) References Cited

U.S. PATENT DOCUMENTS 4,822,025 A * 4/1989 Chung ..... B65H 31/24 209/933
4,843,434 A * 6/1989 Lawrence ..... B65H 31/24 271/293
(Continued)

FOREIGN PATENT DOCUMENTS

FR 2470747 A1 * 6/1981 ..... B65H 29/12
JP 2002-072729 A 3/2002

*Primary Examiner* — Patrick Cicchino
(74) *Attorney, Agent, or Firm* — Studebaker & Brackett PC

(57) ABSTRACT

An image forming apparatus includes an image forming section, a discharging roller pair, a plurality of trays, a guide member, and a controller. The image forming section forms an image on each of a plurality of sheets. The discharging roller pair discharges each of the sheets. The sheets discharged by the discharging roller pair are to be stacked on the trays (first through third trays). The guide member guides each of the sheets from the discharging roller pair toward a discharge destination tray among the plurality of trays. Every time the discharging roller pair discharges one of the sheets, the controller controls the guide member to change the discharge destination tray. The trays are configured such that leading ends of the sheets are superposed on one another.

8 Claims, 13 Drawing Sheets

(51) Int. Cl.
*B65H 31/20* (2006.01)
*B65H 39/11* (2006.01)

(56) References Cited

U.S. PATENT DOCUMENTS

| | | | | | |
|---|---|---|---|---|---|
| 5,131,644 | A * | 7/1992 | DuBois | B65H 39/11 | 271/220 |
| 5,141,222 | A * | 8/1992 | Sawada | B65H 39/105 | 271/292 |
| 5,358,238 | A * | 10/1994 | Mandel | B65H 31/24 | 101/2 |
| 5,603,494 | A * | 2/1997 | Baker | B65H 39/11 | 271/296 |
| 7,311,303 | B2 * | 12/2007 | Gonzalez | B41J 13/106 | 271/296 |
| 8,424,871 | B2 * | 4/2013 | Ino | B65H 31/20 | 271/220 |
| 10,052,864 | B2 * | 8/2018 | Tanaka | B65H 31/02 | |
| 2016/0154358 | A1 * | 6/2016 | Hashimoto | B65H 31/20 | 271/213 |

* cited by examiner

| | | | | |
|---|---|---|---|---|
| Third tray 63 | 9 | 10 | 11 | 12 |
| Second tray 62 | 5 | 6 | 7 | 8 |
| First tray 61 | 1 | 2 | 3 | 4 |

FIG. 7A

| | | | | |
|---|---|---|---|---|
| Third tray 63 | 8 | 9 | 10 | |
| Second tray 62 | 5 | 6 | 7 | |
| First tray 61 | 1 | 2 | 3 | 4 |

FIG. 7B

| | | | | |
|---|---|---|---|---|
| Third tray 63 | 9 | 10 | 11 | |
| Second tray 62 | 5 | 6 | 7 | 8 |
| First tray 61 | 1 | 2 | 3 | 4 |

FIG. 7C

IMAGE FORMING APPARATUS, SORTING DEVICE, AND TRAY UNIT

INCORPORATION BY REFERENCE

The present application claims priority under 35 U.S.C. § 119 to Japanese Patent Application No. 2017-173107, filed on Sep. 8, 2017. The contents of this application are incorporated herein by reference in their entirety.

BACKGROUND

The present disclosure relates to an image forming apparatus, a sorting device, and a tray unit.

Some image forming apparatus includes a fixing section, a plurality of exit ports, a plurality of sheet stacking sections, a sheet cooling fan, and a duct member. The fixing section fixes a toner image to a sheet by heating the toner image. The exit ports discharge sheets to which toner images have been fixed to the respective sheet stacking sections. The sheet cooling fan and the duct member cool sheets discharged from the respective exit ports or sheets discharged to the respective sheet stacking sections by blowing air toward the sheets.

SUMMARY

An image forming apparatus according to the present disclosure includes an image forming section, a discharge device, a plurality of trays, at least one guide member, and a controller. The image forming section forms an image on each of a plurality of recording mediums. The discharge device discharges each of the recording mediums. The recording mediums discharged by the discharge device are to be stacked on the trays. The at least one guide member guides each of the recording mediums from the discharge device toward a discharge destination tray among the plurality of trays. The recording medium guided by the at least one guide member is to be discharged onto the discharge destination tray. Every time one of the recording mediums is discharged by the discharge device, the controller controls the at least one guide member to change the discharge destination tray. The trays are configured such that leading ends of the recording mediums in a discharge direction are superposed on one another.

A sorting device according to the present disclosure includes a plurality of trays and at least one guide member. A plurality of recording mediums are to be stacked on the trays. The at least one guide member guides each of the recording mediums toward a discharge destination tray among the plurality of trays. The recording medium guided by the at least one guide member is to be discharged onto the discharge destination tray. Every time one of the recording mediums is discharged, the at least one guide member changes the discharge destination tray. The trays are configured such that leading ends of the recording mediums in a discharge direction are superposed on one another.

A tray unit according to the present disclosure includes a plurality of trays. A plurality of recording mediums are to be stacked on the trays. Each of the recording mediums is discharged onto a discharge destination tray among the plurality of trays. A length of each of the trays in a discharge direction of the recording mediums is shorter than a length of each of the recording mediums in the discharge direction.

BRIEF DESCRIPTION OF THE DRAWINGS

FIGS. 7A to 7C are diagrams illustrating page numbers of sheets to be discharged onto first through third trays. FIG. 7A is a diagram illustrating a case where the remainder is zero when a total page number is divided by the number of trays. FIG. 7B is a diagram illustrating a case where the remainder is one when a total page number is divided by the number of trays. FIG. 7C is a diagram illustrating a case where the remainder is two when a total page number is divided by the number of trays.

DETAILED DESCRIPTION

Figure 1:
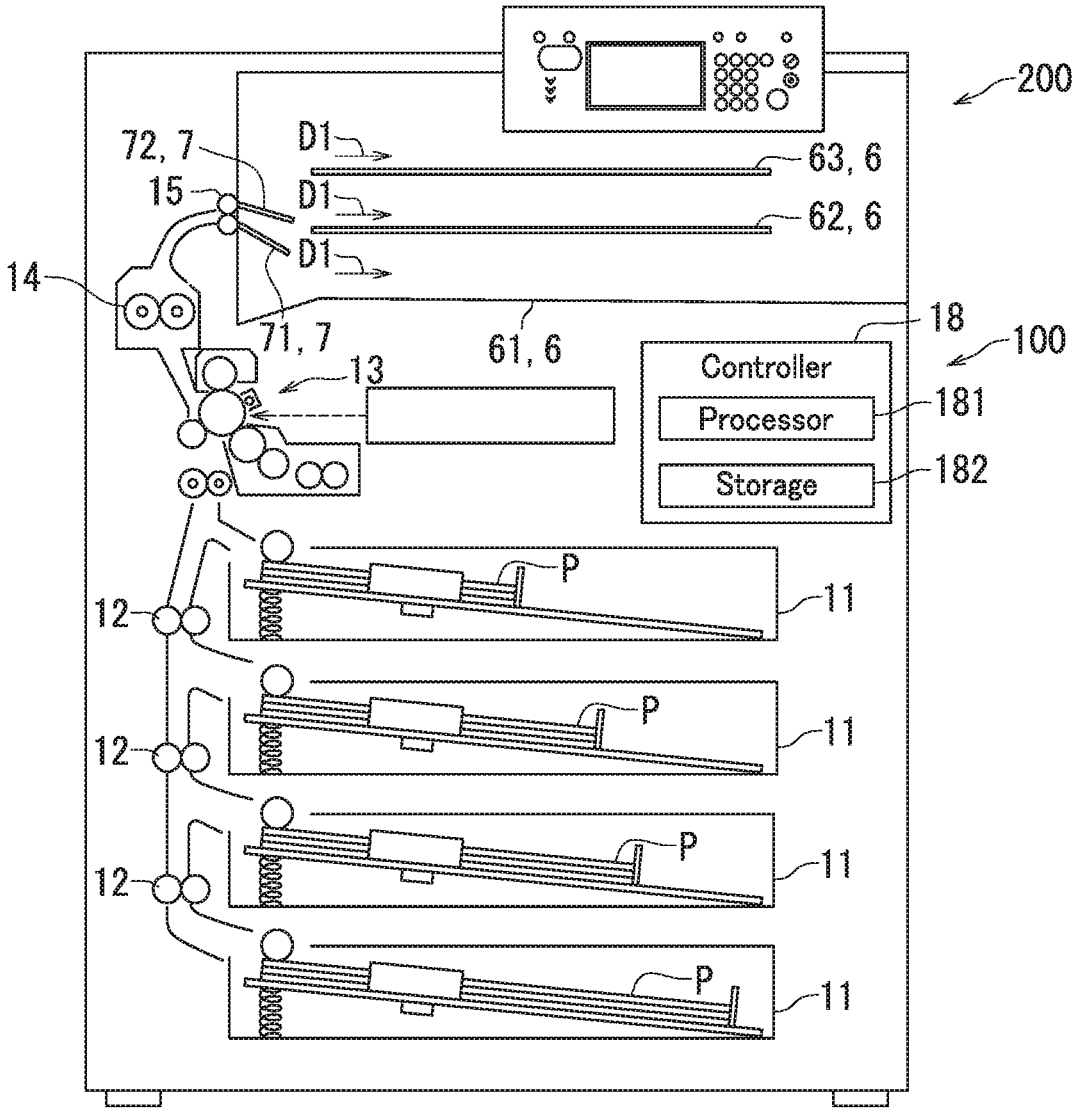
FIG. 1 is a diagram illustrating an example of a configuration of an image forming apparatus according to an embodiment of the present disclosure.

The following describes an embodiment of the present disclosure with reference to the accompanying drawings (FIGS. 1 to 13). In the drawings, elements that are the same or equivalent are labelled using the same reference signs, and description thereof will not be repeated.

First, the following describes an image forming apparatus 100 according to the embodiment of the present disclosure with reference to FIG. 1. FIG. 1 is a diagram illustrating a configuration of the image forming apparatus 100. As illustrated in FIG. 1, the image forming apparatus 100 is a printer. The image forming apparatus 100 forms an image on a sheet P, which is an example of a recording medium.

The image forming apparatus 100 includes feeding cassettes 11, conveyance roller pairs 12, an image forming section 13, a discharging roller pair 15, a sorting device 200, and a controller 18. The image forming section 13 includes a fixing section 14. The sorting device 200 includes an exit tray 6 and a guide member 7. Sheets P fed from the feeding cassettes 11 are conveyed to the image forming section 13 by the conveyance roller pairs 12.

The image forming section 13 forms an image on a sheet P. Specifically, the image forming section 13 includes a photosensitive drum, a charger, a light exposure section, a developing section, a transfer section, a cleaning section, and a static eliminator. The image (toner image) is formed on the sheet P by the photosensitive drum, the charger, the light exposure section, the developing section, and the transfer section.

The fixing section 14 fixes the toner image formed on the sheet P to the sheet P. The discharging roller pair 15 discharges sheets P to the exit tray 6 sheet by sheet. The discharging roller pair 15 is an example of a "discharge device".

Plural sheets P discharged by the discharging roller pair 15 are stacked on the exit tray 6. The exit tray 6 includes a first tray 61, a second tray 62, and a third tray 63. The second tray 62 is located above the first tray 61. The third tray 63 is located above the second tray 62. The first through third trays 61 to 63 are configured such that leading ends PA of the sheets P in a discharge direction D1 are superposed on one another (see FIG. 11 described later). The first through third trays 61 to 63 are equivalent to an example of "a plurality of trays". Also, the first tray 61 and the second tray 62 are equivalent to an example of "a tray unit".

The guide member 7 guides each of the sheets P from the discharging roller pair 15 toward a discharge destination tray TR, which is any of the first through third trays 61 to 63 (see FIGS. 4 to 6 described later). The guide member 7 includes a first guide member 71 and a second guide member 72. The first guide member 71 and the second guide member 72 will be described later in detail with reference to FIGS. 2 to 4.

The controller 18 controls operation of the image forming apparatus 100. The controller 18 includes a processor 181 and storage 182. The processor 181 includes for example a central processing unit (CPU). The storage 182 includes memory such as semiconductor memory and may further include a hard disk drive (HDD). The storage 182 stores a control program therein. The processor 181 controls the operation of the image forming apparatus 100 through execution of the control program. Specifically, every time the discharging roller pair 15 discharges a sheet P among the plural sheets P, the controller 18 controls the guide member 7 to change the discharge destination tray TR.

As described above with reference to FIG. 1, every time the discharging roller pair 15 discharges a sheet P among the plural sheets P, the guide member 7 is controlled to change the discharge destination tray TR in the embodiment of the present disclosure. Therefore, the sheets P are prevented from being successively stacked on the same tray, whereby cooling of the sheets P is facilitated. Accordingly, the sheets P can be cooled with a simple configuration. As a result, adhesion of the sheets P to one another can be inhibited. Also, the first through third trays 61 to 63 are configured such that the leading ends PA of the sheets P are superposed on one another. Therefore, it is easy to collect the sheets P from the first through third trays 61 to 63.

Although the image forming apparatus 100 in the embodiment of the present disclosure includes the first through third trays 61 to 63, the present disclosure is not limited to this configuration. It is only required that the image forming apparatus 100 include a plurality of exit trays. The image forming apparatus 100 may include for example only two exit trays or more than three exit trays.

Figure 2:
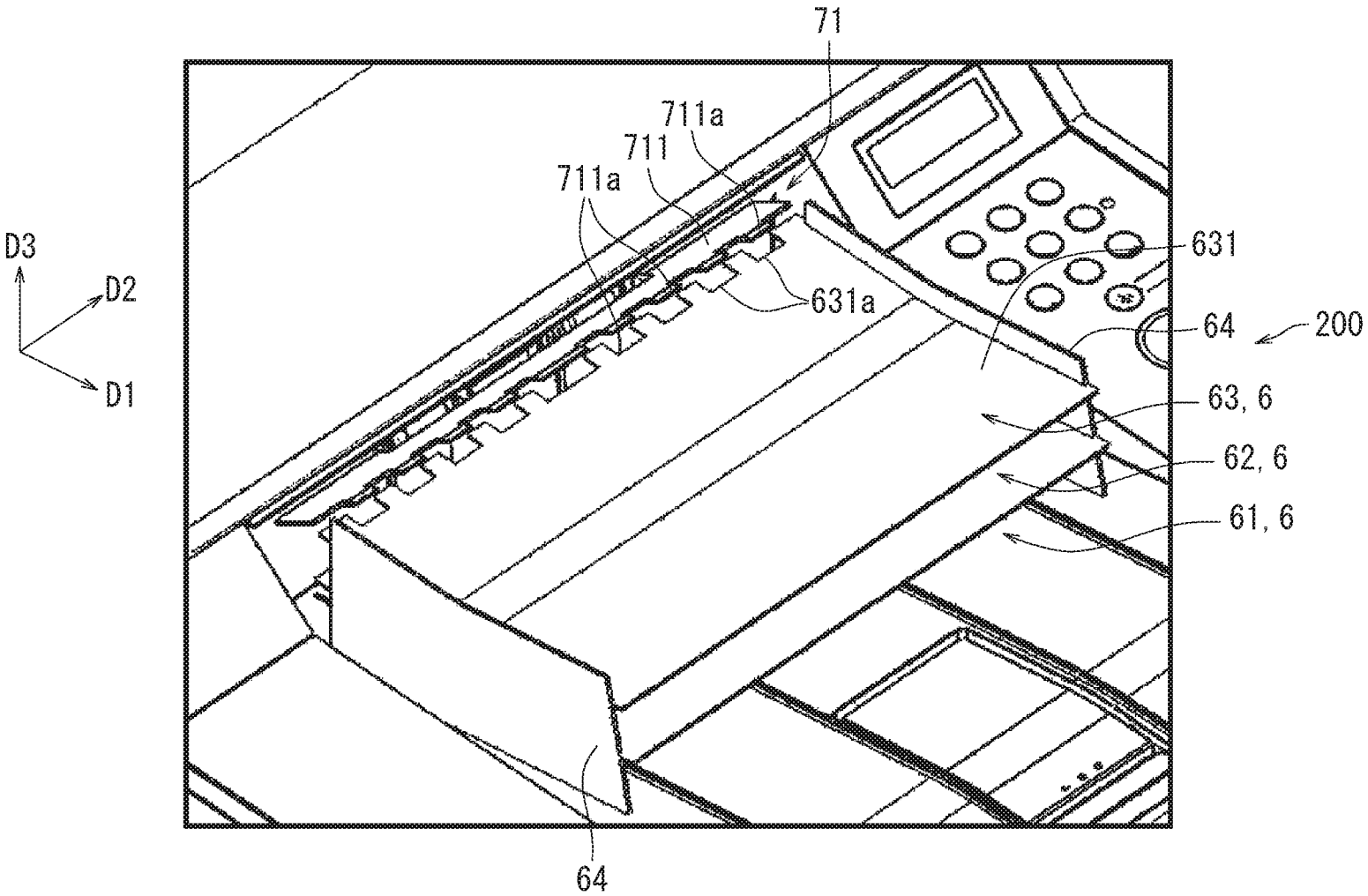
FIG. 2 is a perspective view illustrating an example of a configuration of a sorting device.
Figure 3:
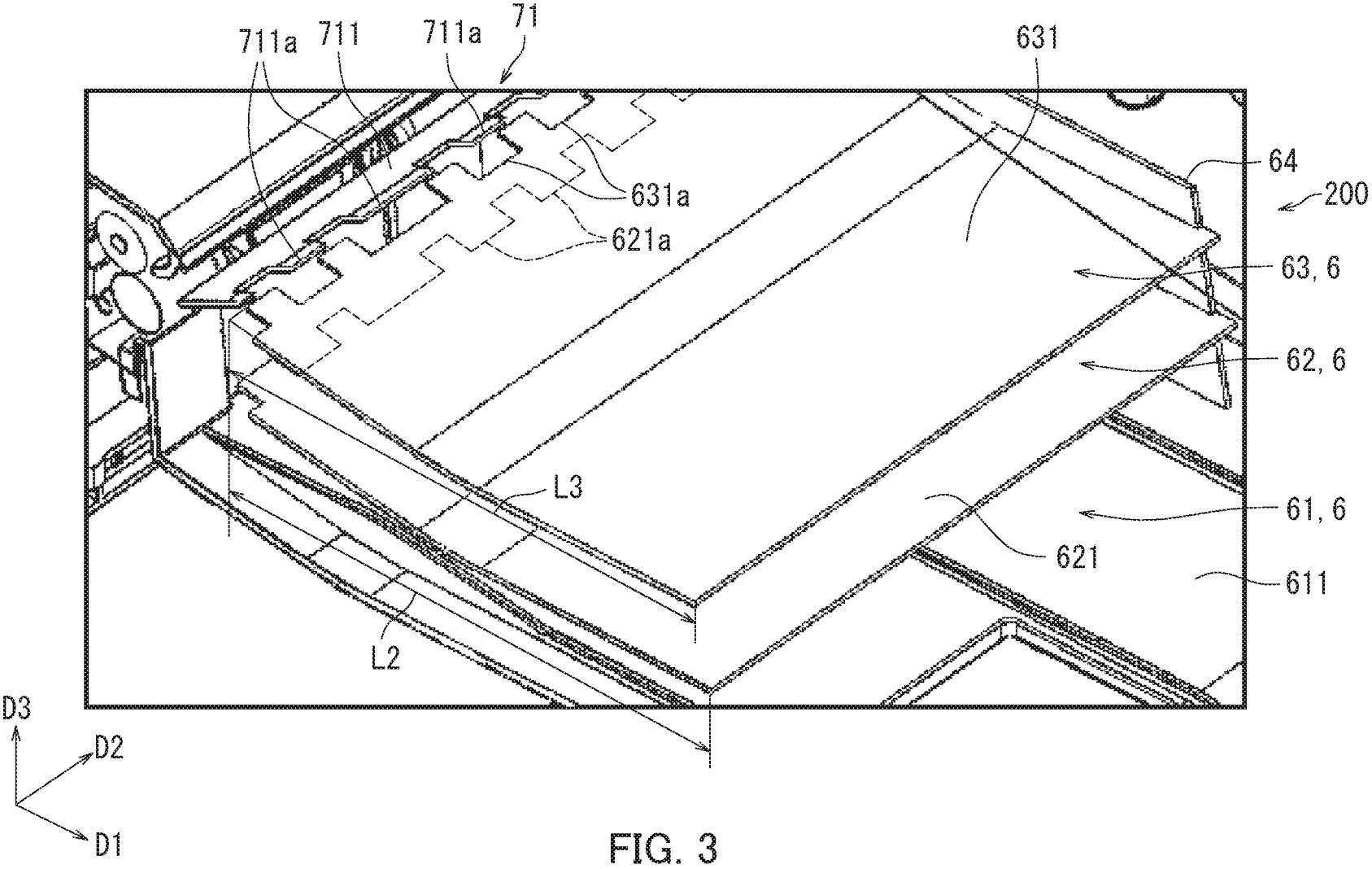
FIG. 3 is a perspective view illustrating an example of the configuration of the sorting device.

The following describes a configuration of the sorting device 200 with reference to FIGS. 1 to 3. FIGS. 2 and 3 are perspective views each illustrating an example of the configuration of the sorting device 200. As illustrated in FIGS. 2 and 3, the first guide member 71 includes a first plate-like member 711. The first plate-like member 711 is pivotably supported. Note that the second guide member 72 is omitted in FIGS. 2 and 3 for simplification of the drawings.

The first plate-like member 711 includes a plurality of projections 711*a*. The projections 711*a* are provided at an end of the first plate-like member 711 in the discharge direction D1. Each of the projections 711*a* projects in the discharge direction D1. The projections 711*a* are arranged in a direction D2. The direction D2 is perpendicular to the discharge direction D1 and a direction D3. The direction D3 indicates a vertical direction.

The third tray 63 includes a third tray body 631. The third tray body 631 is a rectangular plate-like member arranged in the discharge direction D1. The third tray body 631 extends in the direction D2. Sheets P are to be placed on an upper surface of the third tray body 631.

The third tray body 631 includes a plurality of recesses 631*a*. The recesses 631*a* are provided at an end of the third tray body 631 in a direction opposite to the discharge direction D1. Each of the recesses 631*a* is an indented space formed in the discharge direction D1. The recesses 631*a* are arranged in the direction D2.

The first plate-like member 711 pivots in a manner that the projections 711*a* pass through the respective recesses 631*a*. That is, when the first plate-like member 711 pivots, the projections 711*a* pass through the respective recesses 631*a*. Specifically, the projections 711*a* pass through the recesses 631*a* respectively located opposite to the projections 711*a*.

Similarly to the third tray 63, the second tray 62 includes a second tray body 621. The second tray body 621 is a rectangular plate-like member arranged in the discharge direction D1. The second tray body 621 extends in the direction D2. Sheets P are to be placed on an upper surface of the second tray body 621.

The second tray body 621 includes a plurality of recesses 621*a*. The recesses 621*a* are provided at an end of the second tray body 621 in the direction opposite to the discharge direction D1. Each of the recesses 621*a* is an indented space formed in the discharge direction D1. The recesses 621*a* are arranged in the direction D2.

The first plate-like member 711 pivots in a manner that the projections 711*a* pass through the respective recesses 621*a*. That is, when the first plate-like member 711 pivots, the projections 711*a* pass through the respective recesses 621*a*. Specifically, the projections 711*a* pass through the recesses 621*a* respectively located opposite to the projections 711*a*.

The exit tray 6 further includes a pair of support members 64. The pair of support members 64 supports the second tray body 621 and the third tray body 631. Specifically, the pair of support members 64 supports opposite ends of the second tray body 621 in the direction D2 and opposite ends of the third tray body 631 in the direction D2. The support members 64 are plate-like members standing on an upper surface of the first tray 61.

As illustrated in FIG. 3, the first tray 61 includes a first tray body 611. The first tray body 611 is a rectangular plate-like member arranged in the discharge direction D1. The first tray body 611 extends in the direction D2. Sheets P are to be placed on an upper surface of the first tray body 611.

A length of the second tray body 621 in the discharge direction D1 is indicated as a length L2. A length of the third tray body 631 in the discharge direction D1 is indicated as a length L3. The length L2 and the length L3 are shorter than a length LP, which is a length of each sheet P in the discharge direction D1.

As described above with reference to FIGS. 1 to 3, the projections 711*a* projecting in the discharge direction D1 of the sheets P are provided at the end of the first plate-like member 711 in the discharge direction D1 in the embodiment of the present disclosure. Further, the recesses 621*a*, which are indented spaces formed in the discharge direction D1 of the sheets P, are provided at the end of the second tray body 621 in the direction opposite to the discharge direction D1. Also, the recesses 631*a*, which are indented spaces formed in the discharge direction D1 of the sheets P, are provided at the end of the third tray body 631 in the direction opposite to the discharge direction D1. The first plate-like member 711 pivots in a manner that the projections 711*a* pass through the recesses 621*a* and 631*a*. In this configuration, the sheets P are prevented from striking the respective ends of the second tray body 621 and the third tray body 631 in the direction opposite to the discharge direction D1. Therefore, the first guide member 71 can accurately guide each sheet P toward the discharge destination tray TR.

Further, the length L2 and the length L3 are shorter than the length LP. In this configuration, leading ends PA of sheets P discharged onto the second tray body 621 and leading ends PA of sheets P discharged onto the third tray body 631 fall downwards to be located on sheets P discharged onto the first tray body 611. Thus, the leading ends PA of the sheets P respectively discharged onto the second tray body 621 and the third tray body 631 can be superposed on leading ends PA of the sheets P discharged onto the first tray body 611. This will be described later in detail with reference to FIG. 11.

Although the first plate-like member 711 in the embodiment of the present disclosure includes the projections 711*a*, the present disclosure is not limited to this configuration. It is only required that at least one of the first plate-like member 711 and a second plate-like member 721 of the second guide member 72 (see FIG. 4 described below) include projections. Preferably, the first plate-like member 711 and the second plate-like member 721 both include projections.

Although the first plate-like member 711 in the embodiment of the present disclosure includes the plurality of projections 711*a*, the present disclosure is not limited to this configuration. It is only required that the first plate-like member 711 include at least one projection. A first plate-like member 711 including fewer projections is easier to produce. A first plate-like member 711 including at least a specific number of (for example, five) projections makes it possible to prevent the sheets P from striking the respective ends of the second tray body 621 and the third tray body 631 in the direction opposite to the discharge direction D1.

Although the second tray body 621 includes the recesses 621*a* and the third tray body 631 includes the recesses 631*a* in the embodiment of the present disclosure, the present disclosure is not limited to this configuration. It is only required that the second tray body 621 include the recesses 621*a* or the third tray body 631 include the recesses 631*a*.

Figure 4:
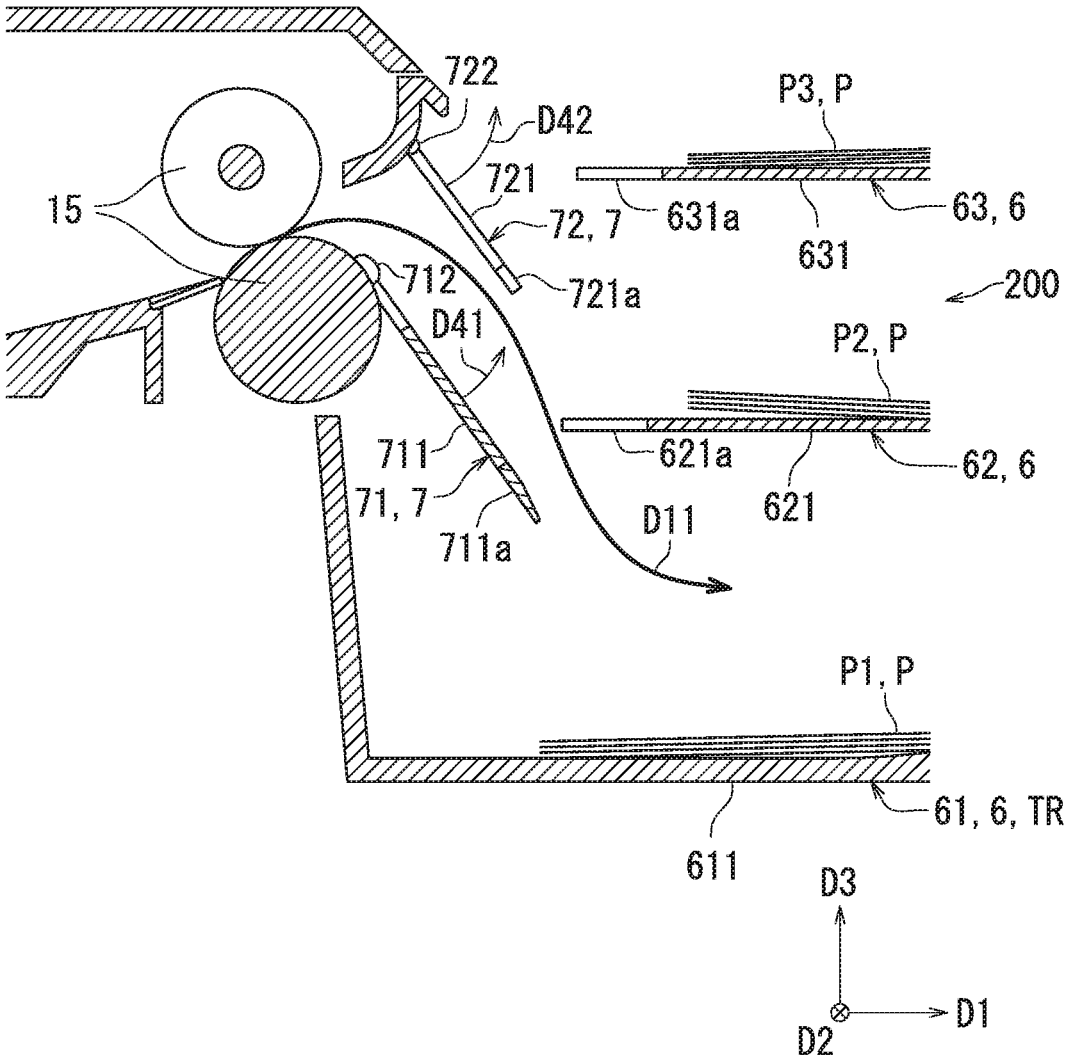
FIG. 4 is a side view illustrating operation of the sorting device.

The following describes a configuration and operation of the sorting device 200 with reference to FIGS. 1 to 6. FIG. 4 is a side view illustrating the operation of the sorting device 200. In the state illustrated in FIG. 4, the sorting device 200 discharges a sheet P onto the first tray 61. As illustrated in FIG. 4, the first guide member 71 further includes a first support member 712. The second guide member 72 further includes a second support member 722.

The first support member 712 pivotably supports the first plate-like member 711. The first support member 712 extends in the direction D2. The first support member 712 is rotationally driven by a motor, for example.

The second support member 722 pivotably supports the second plate-like member 721. The second support member 722 extends in the direction D2. The second support member 722 is rotationally driven by a motor, for example.

The second plate-like member 721 includes a plurality of projections 721*a*. The projections 721*a* are provided at an end of the second plate-like member 721 in the discharge direction D1. Each of the projections 721*a* projects in the discharge direction D1. The projections 721*a* are arranged in the direction D2.

The second plate-like member 721 pivots in a manner that the projections 721*a* pass through the respective recesses 631*a*. That is, when the second plate-like member 721 pivots, the projections 721*a* pass through the respective recesses 631*a*. Specifically, the recesses 631*a* are respectively located opposite to the projections 721*a*.

When a sheet P is to be discharged onto the first tray 61, the end of the first plate-like member 711 in the discharge direction D1 is located above an end of the first tray body 611 in the direction opposite to the discharge direction D1. The end of the second plate-like member 721 in the discharge direction D1 is located above the end of the second tray body 621 in the direction opposite to the discharge direction D1. The second plate-like member 721 is disposed to be substantially parallel to the first plate-like member 711.

A sheet P is discharged from the discharging roller pair 15 onto the first tray 61 as indicated by a direction D11 with a lower surface of the sheet P being guided by the first plate-like member 711 and an upper surface of the sheet P being guided by the second plate-like member 721. The direction D11 indicates a direction of travel of the sheet P discharged from the discharging roller pair 15. Thus, the sheet P is placed on the first tray 61. The sheet P placed on the first tray 61 will be referred to below as a sheet P1.

After the sheet P is placed on the first tray 61, the controller 18 controls the guide member 7 to discharge another sheet P from the discharging roller pair 15 onto the second tray 62. Specifically, the first plate-like member 711 is caused to pivot in a direction D41 about the first support member 712 and the second plate-like member 721 is caused to pivot in a direction D42 about the second support member 722. The direction D41 and the direction D42 each indicate a counter-clockwise direction.

Figure 5:
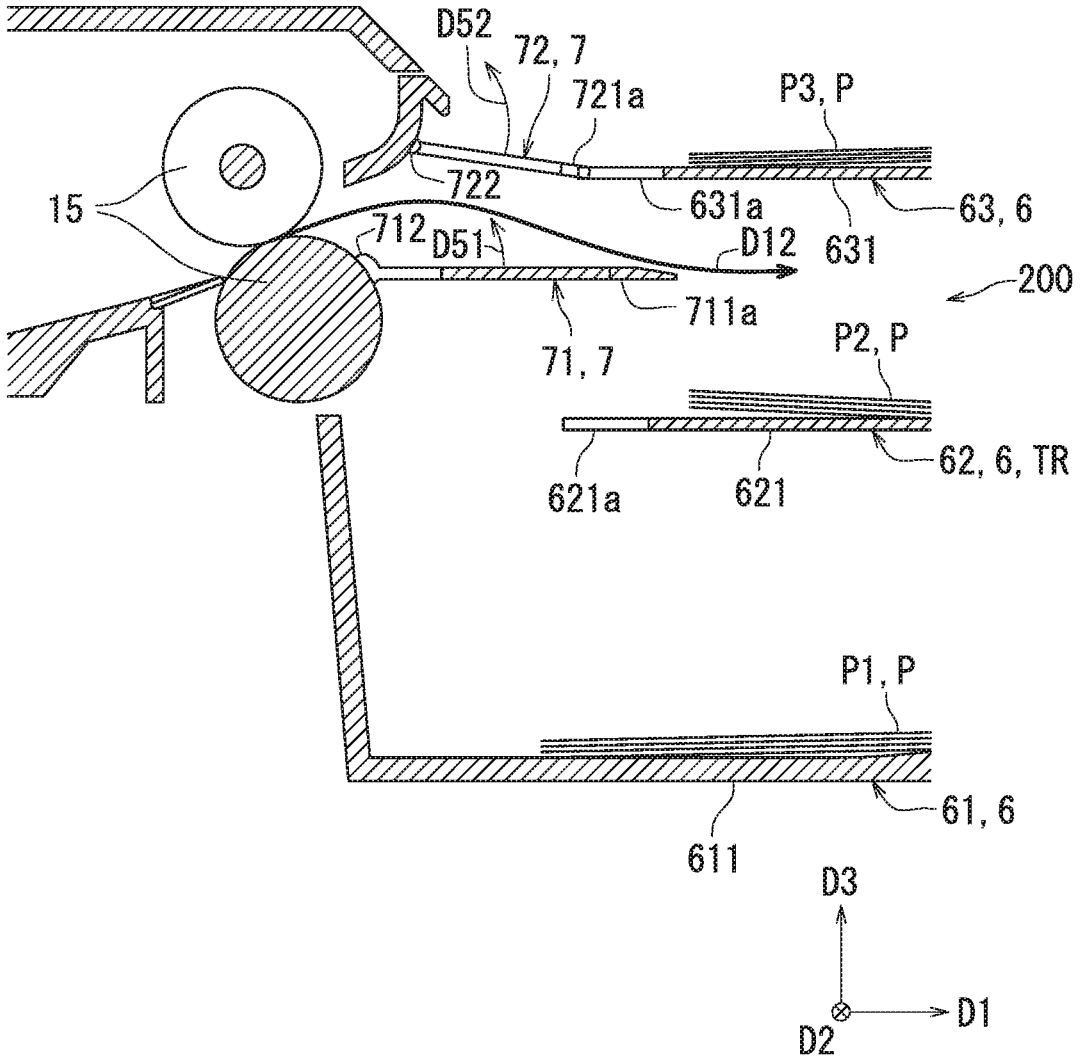
FIG. 5 is a side view illustrating operation of the sorting device.

FIG. 5 is a side view illustrating operation of the sorting device 200. In the state illustrated in FIG. 5, the sorting device 200 discharges a sheet P onto the second tray 62. As illustrated in FIG. 5, when a sheet P is to be discharged onto the second tray 62, the end of the first plate-like member 711 in the discharge direction D1 is located above the end of the second tray body 621 in the direction opposite to the discharge direction D1. The end of the second plate-like member 721 in the discharge direction D1 is located near the end of the third tray body 631 in the direction opposite to the discharge direction D1. The second plate-like member 721 is disposed to be substantially parallel to the first plate-like member 711.

A sheet P is discharged from the discharging roller pair 15 onto the second tray 62 as indicated by a direction D12 with a lower surface of the sheet P being guided by the first plate-like member 711 and an upper surface of the sheet P being guided by the second plate-like member 721. The direction D12 indicates a direction of travel of the sheet P discharged from the discharging roller pair 15. Thus, the sheet P is placed on the second tray 62. The sheet P placed on the second tray 62 will be referred to below as a sheet P2.

After the sheet P is placed on the second tray 62, the controller 18 controls the guide member 7 to discharge another sheet P from the discharging roller pair 15 onto the third tray 63. Specifically, the first plate-like member 711 is caused to pivot in a direction D51 about the first support member 712 and the second plate-like member 721 is caused to pivot in a direction D52 about the second support member 722. The direction D51 and the direction D52 each indicate a counter-clockwise direction.

Figure 6:
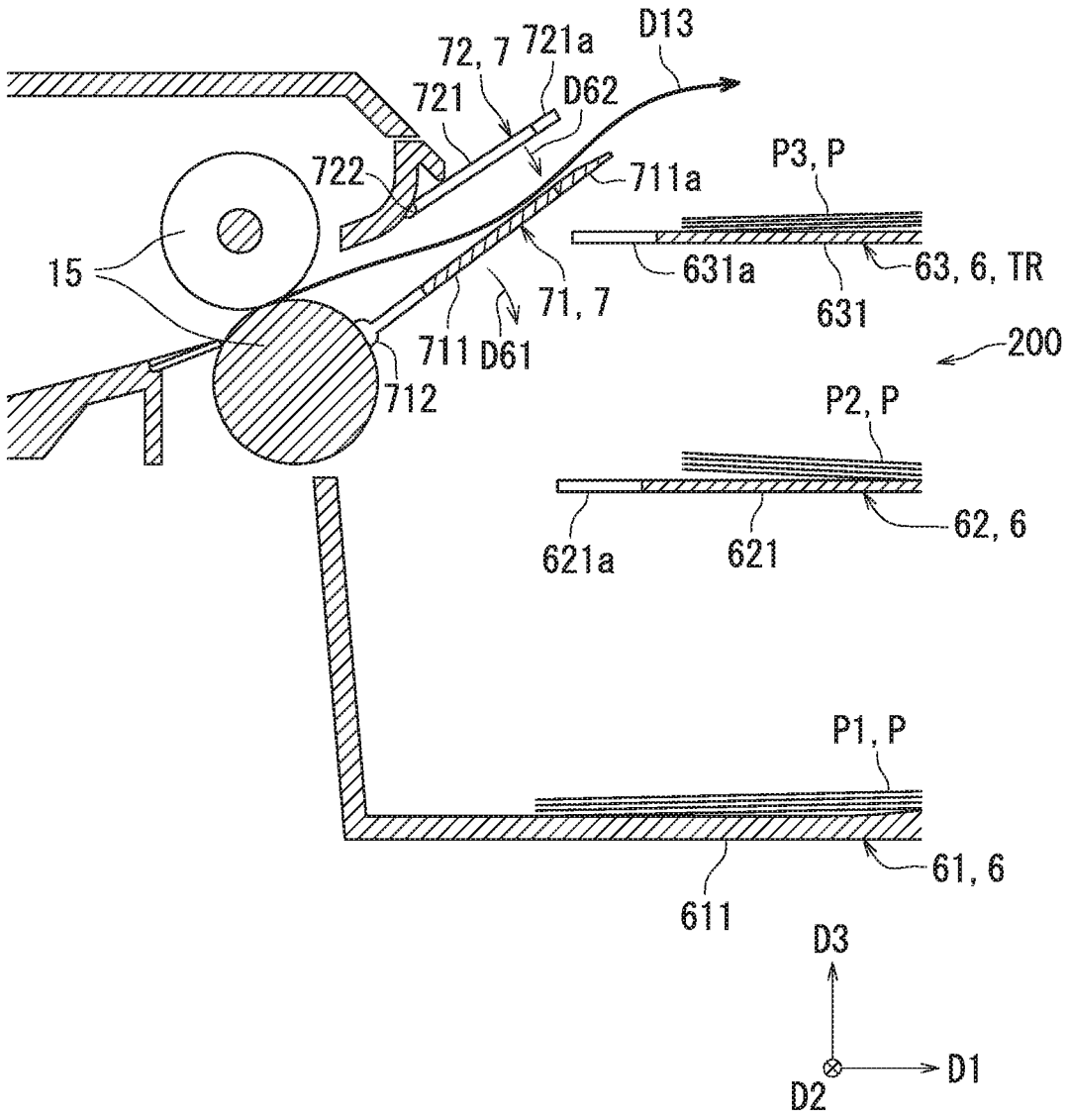
FIG. 6 is a side view illustrating operation of the sorting device.

FIG. 6 is a side view illustrating operation of the sorting device 200. In the state illustrated in FIG. 6, the sorting device 200 discharges a sheet P onto the third tray 63. As illustrated in FIG. 6, when a sheet P is to be discharged onto the third tray 63, the end of the first plate-like member 711 in the discharge direction D1 is located above the end of the third tray body 631 in the direction opposite to the discharge direction D1. The end of the second plate-like member 721 in the discharge direction D1 is located above the end of the first plate-like member 711 in the discharge direction D1. The second plate-like member 721 is disposed to be substantially parallel to the first plate-like member 711.

A sheet P is discharged from the discharging roller pair 15 onto the third tray 63 as indicated by a direction D13 with a lower surface of the sheet P being guided by the first plate-like member 711 and an upper surface of the sheet P being guided by the second plate-like member 721. The direction D13 indicates a direction of travel of the sheet P discharged from the discharging roller pair 15. Thus, the sheet P is placed on the third tray 63. The sheet P placed on the third tray 63 will be referred to below as a sheet P3.

After the sheet P is placed on the third tray 63, the controller 18 controls the guide member 7 to discharge another sheet P from the discharging roller pair 15 onto the first tray 61. Specifically, the first plate-like member 711 is caused to pivot in a direction D61 about the first support member 712 and the second plate-like member 721 is caused to pivot in a direction D62 about the second support member 722. The direction D61 and the direction D62 each indicate a clockwise direction.

As described above with reference to FIGS. 1 to 6, every time a sheet P is discharged from the discharging roller pair 15, the first guide member 71 and the second guide member 72 are controlled to change the discharge destination tray TR in the embodiment of the present disclosure. For example, the discharge destination tray TR is changed to the first tray 61, the second tray 62, and the third tray 63, in the stated order. After the discharge destination tray TR is changed to the third tray 63, the discharge destination tray TR is changed to the first tray 61, for example. Therefore, the sheets P are prevented from being successively stacked on the same tray, whereby cooling of the sheets P is facilitated. Accordingly, the sheets P can be cooled with a simple configuration.

Further, the guide member 7 includes the first guide member 71 and the second guide member 72. The first guide member 71 guides the lower surface of each sheet P. The second guide member 72 guides the upper surface of each sheet P. In this configuration, the first guide member 71 prevents the sheet P from being discharged mistakenly onto a tray located below the discharge destination tray TR and the second guide member 72 prevents the sheet P from being discharged mistakenly onto a tray located above the discharge destination tray TR. Thus, the guide member 7 can reliably guide the sheet P.

Although the image forming apparatus 100 includes the first guide member 71 and the second guide member 72 in the embodiment of the present disclosure, the present disclosure is not limited to this configuration. It is only required that the image forming apparatus 100 include at least one of the first guide member 71 and the second guide member 72. For example, the image forming apparatus 100 may include the first guide member 71 only or the second guide member 72 only.

The following describes with reference to FIGS. 4 to 10 processing performed by the controller 18 in a situation in which a page number is given to each sheet P. The controller 18 controls the guide member 7 to change the discharge destination tray TR such that the sheets P are stacked on the first through third trays 61 to 63 in the order of the page numbers. Specifically, the controller 18 controls the guide member 7 as described below with reference to FIGS. 7 to 10 to change the discharge destination tray TR.

FIGS. 7A to 7C are diagrams illustrating page numbers of sheets P to be discharged onto the first through third trays 61 to 63. FIG. 7A is a diagram illustrating a case where the remainder is zero when a total page number N is divided by the number of trays (=3). FIG. 7B is a diagram illustrating a case where the remainder is one when a total page number N is divided by the number of trays. FIG. 7C is a diagram illustrating a case where the remainder is two when a total page number N is divided by the number of trays.

The following describes a case where the total page number N is 12 with reference to FIG. 7A. As illustrated in FIG. 7A, a sheet P with an image of the first page formed thereon is discharged onto the first tray 61, a sheet P with an image of the fifth page formed thereon is discharged onto the second tray 62, and a sheet P with an image of the ninth page formed thereon is discharged onto the third tray 63. Then, a sheet P with an image of the second page formed thereon is discharged onto the first tray 61, a sheet P with an image of the sixth page formed thereon is discharged onto the second tray 62, and a sheet P with an image of the tenth page is discharged onto the third tray 63.

Next, a sheet P with an image of the third page formed thereon is discharged onto the first tray 61, a sheet P with an image of the seventh page formed thereon is discharged onto the second tray 62, and a sheet P with an image of the eleventh page formed thereon is discharged onto the third tray 63. Finally, a sheet P with an image of the fourth page formed thereon is discharged onto the first tray 61, a sheet P with an image of the eighth page formed thereon is discharged onto the second tray 62, and a sheet P with an image of the twelfth page formed thereon is discharged onto the third tray 63.

By changing the discharge destination tray TR as above, the sheets P with the images of the first through fourth pages formed respectively thereon are stacked on the first tray 61 in order from the bottom. Also, the sheets P with the images of the fifth through eighth pages formed respectively thereon are stacked on the second tray 62 in order from the bottom. Further, the sheets P with the images of the ninth through twelfth pages formed respectively thereon are stacked on the third tray 63 in order from the bottom. Thus, the sheets P can be stacked on the first through third trays 61 to 63 in the order of the page numbers.

The following describes a case where the total page number N is 10 with reference to FIG. 7B. As illustrated in FIG. 7B, a sheet P with an image of the first page formed thereon is discharged onto the first tray 61, a sheet P with an image of the fifth page formed thereon is discharged onto the second tray 62, and a sheet P with an image of the eighth page formed thereon is discharged onto the third tray 63. Then, a sheet P with an image of the second page formed thereon is discharged onto the first tray 61, a sheet P with an image of the sixth page formed thereon is discharged onto the second tray 62, and a sheet P with an image of the ninth page formed thereon is discharged onto the third tray 63.

Next, a sheet P with an image of the third page formed thereon is discharged onto the first tray 61, a sheet P with an image of the seventh page formed thereon is discharged onto the second tray 62, and a sheet P with an image of the tenth page formed thereon is discharged onto the third tray 63. Finally, a sheet P with an image of the fourth page formed thereon is discharged onto the first tray 61.

By changing the discharge destination tray TR as above, the sheets P with the images of the first through fourth pages formed respectively thereon are stacked on the first tray 61 in order from the bottom. Also, the sheets P with the images of the fifth through seventh pages formed respectively thereon are stacked on the second tray 62 in order from the bottom. Further, the sheets P with the images of the eighth through tenth pages formed respectively thereon are stacked on the third tray 63 in order from the bottom. Thus, the sheets P can be stacked on the first through third trays 61 to 63 in the order of the page numbers.

The following describes a case where the total page number N is 11 with reference to FIG. 7C. As illustrated in FIG. 7C, a sheet P with an image of the first page formed thereon is discharged onto the first tray 61, a sheet P with an image of the fifth page formed thereon is discharged onto the second tray 62, and a sheet P with an image of the ninth page formed thereon is discharged onto the third tray 63. Then, a sheet P with an image of the second page formed thereon is discharged onto the first tray 61, a sheet P with an image of the sixth page formed thereon is discharged onto the second tray 62, and a sheet P with an image of the tenth page formed thereon is discharged onto the third tray 63.

Next, a sheet P with an image of the third page formed thereon is discharged onto the first tray 61, a sheet P with an image of the seventh page formed thereon is discharged onto the second tray 62, and a sheet P with an image of the eleventh page formed thereon is discharged onto the third tray 63. Finally, a sheet P with an image of the fourth page formed thereon is discharged onto the first tray 61 and a sheet P with an image of the eighth page formed thereon is discharged onto the second tray 62.

By changing the discharge destination tray TR as above, the sheets P with the images of the first through fourth pages formed respectively thereon are stacked on the first tray 61 in order from the bottom. Also, the sheets P with the images of the fifth through eighth pages formed respectively thereon are stacked on the second tray 62 in order from the bottom. Further, the sheets P with the images of the ninth through eleventh pages formed respectively thereon are stacked on the third tray 63 in order from the bottom. Thus, the sheets P can be stacked on the first through third trays 61 to 63 in the order of the page numbers.

Figure 8:
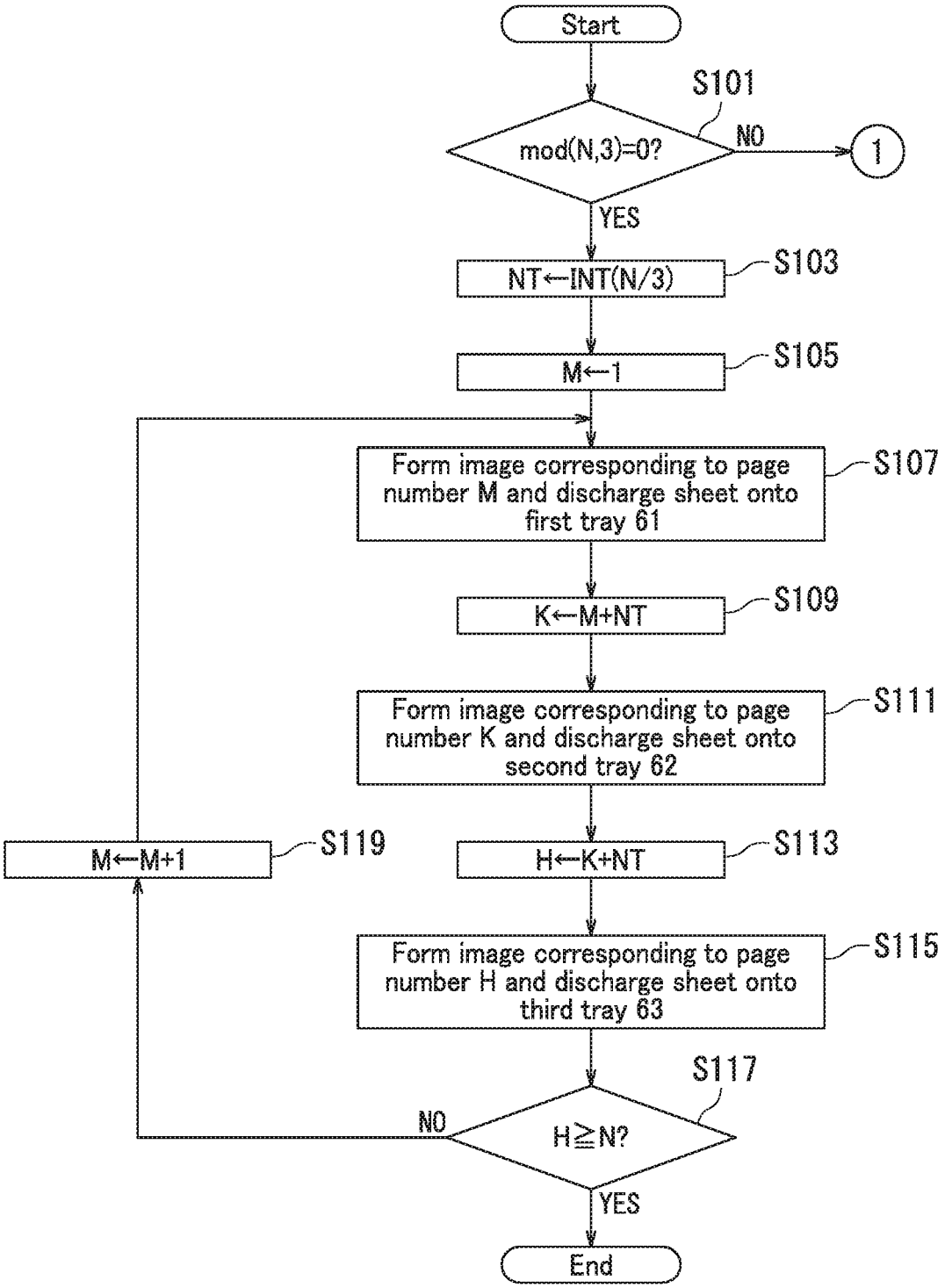
FIG. 8 is a flowchart illustrating an example of processing performed by a controller.
Figure 9:
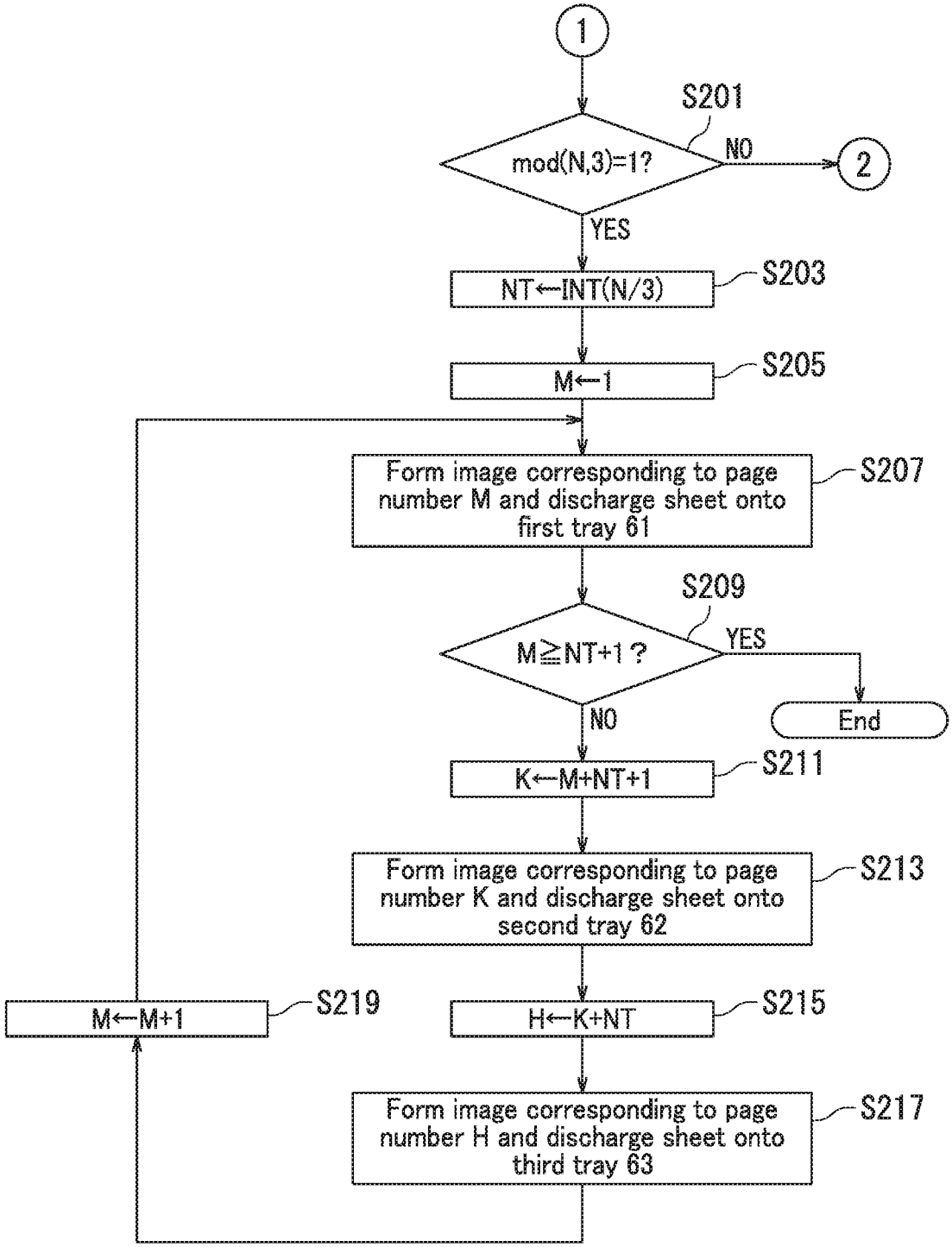
FIG. 9 is a flowchart illustrating an example of processing performed by the controller.
Figure 10:
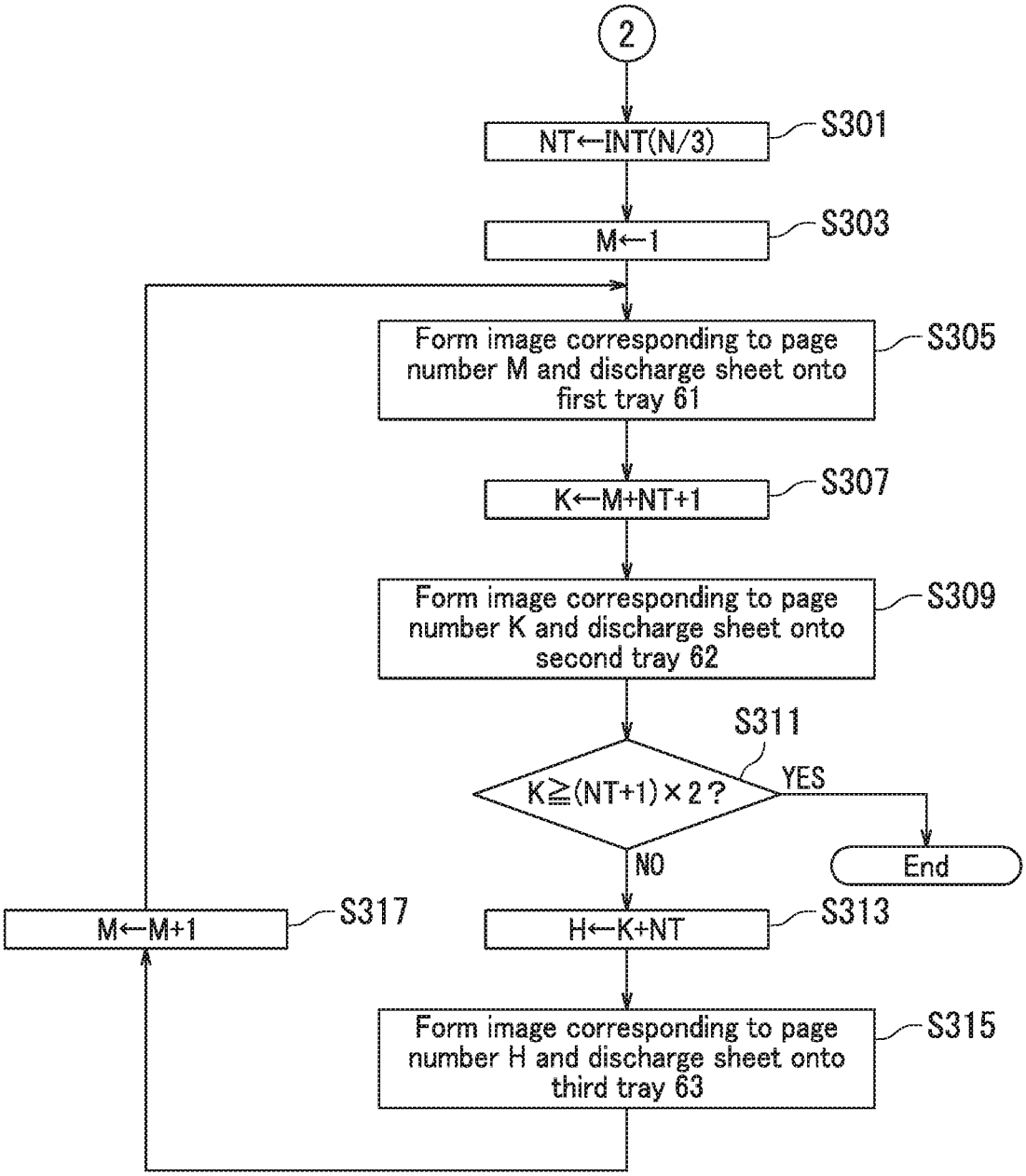
FIG. 10 is a flowchart illustrating an example of processing performed by the controller.

FIGS. 8 to 10 are flowcharts illustrating examples of processing performed by the controller 18.

As illustrated in FIG. 8, first at Step S101, the controller 18 determines whether or not the remainder is zero when a total page number N is divided by the number of trays (=3). Note that "mod(N,3)" represents the remainder when the total page number N is divided by the number of trays (=3).

When the controller 18 determines that the remainder is not zero when the total page number N is divided by the number of trays (NO at Step S101), the routine proceeds to Step S201 in FIG. 9. When the controller 18 determines that the remainder is zero when the total page number N is divided by the number of trays (YES at Step S101), the routine proceeds to Step S103.

At Step S103, the controller 18 assigns to a constant NT an integer part of a quotient of the total page number N divided by the number of trays (=3). Note that "INT(N/3)" represents the integer part of the quotient of the total page number N divided by 3.

Next at Step S105, the controller 18 assigns "1" to a page number M.

Then at Step S107, the controller 18 controls the image forming section 13 to form an image corresponding to the page number M on a sheet P and controls the guide member 7 to discharge the sheet P onto the first tray 61.

Next at Step S109, the controller 18 assigns a sum of the page number M and the constant NT to a page number K.

Then at Step S111, the controller 18 controls the image forming section 13 to form an image corresponding to the page number K on a sheet P and controls the guide member 7 to discharge the sheet P onto the second tray 62.

Next at Step S113, the controller 18 assigns a sum of the page number K and the constant NT to a page number H.

Then at Step S115, the controller 18 controls the image forming section 13 to form an image corresponding to the page number H on a sheet P and controls the guide member 7 to discharge the sheet P onto the third tray 63.

Next at Step S117, the controller 18 determines whether or not the page number H is equal to or greater than the total page number N.

When the controller 18 determines that the page number H is equal to or greater than the total page number N (YES at Step S117), the processing ends. When the controller 18 determines that the page number H is neither equal to nor greater than the total page number N (NO at Step S117), the routine proceeds to Step S119.

At Step S119, the controller 18 increments the page number M by one, and the routine then returns to Step S107.

When a negative determination is made at Step S101, the controller 18 determines, at Step S201 in FIG. 9, whether or not the remainder is one when the total page number N is divided by the number of trays (=3).

When the controller 18 determines that the remainder is not one when the total page number N is divided by the number of trays (NO at Step S201), the routine proceeds to Step S301 in FIG. 10. When the controller 18 determines that the remainder is one when the total page number N is divided by the number of trays (YES at Step S201), the routine proceeds to Step S203.

At Step S203, the controller 18 assigns to a constant NT an integer part of a quotient of the total page number N divided by the number of trays (=3).

Next at Step S205, the controller 18 assigns "1" to a page number M.

Then at Step S207, the controller 18 controls the image forming section 13 to form an image corresponding to the page number M on a sheet P and controls the guide member 7 to discharge the sheet P onto the first tray 61.

Next at Step S209, the controller 18 determines whether or not the page number M is equal to or greater than (constant NT+1).

When the controller 18 determines that the page number M is equal to or greater than (constant NT+1) (YES at Step S209), the processing ends. When the controller 18 determines that the page number M is neither equal to nor greater than (constant NT+1) (NO at Step S209), the routine proceeds to Step S211.

At Step S211, the controller 18 assigns to a page number K a sum of the page number M and (constant NT+1).

Then at Step S213, the controller 18 controls the image forming section 13 to form an image corresponding to the page number K on a sheet P and controls the guide member 7 to discharge the sheet P onto the second tray 62.

Next at Step S215, the controller 18 assigns a sum of the page number K and the constant NT to a page number H.

Next at Step S217, the controller 18 controls the image forming section 13 to form an image corresponding to the page number H on a sheet P and controls the guide member 7 to discharge the sheet P onto the third tray 63.

Then at Step S219, the controller 18 increments the page number M by one, and the routine then returns to Step S207.

When a negative determination is made at Step S201, the controller 18 assigns, at Step S301 in FIG. 10, an integer part of a quotient of the total page number N divided by the number of trays (=3) to a constant NT.

Then at Step S303, the controller 18 assigns "1" to a page number M.

Next at Step S305, the controller 18 controls the image forming section 13 to form an image corresponding to the page number M on a sheet P and controls the guide member 7 to discharge the sheet P onto the first tray 61.

Next at Step S307, the controller 18 assigns to a page number K a sum of the page number M and (constant NT+1).

Then at Step S309, the controller 18 controls the image forming section 13 to form an image corresponding to the page number K on a sheet P and controls the guide member 7 to discharge the sheet P onto the second tray 62.

Next at Step S311, the controller 18 determines whether or not the page number K is equal to or greater than [(constant NT+1)×2].

When the controller 18 determines that the page number K is equal to or greater than [(constant NT+1)×2] (YES at Step S311), the processing ends. When the controller 18 determines that the page number K is neither equal to nor greater than [(constant NT+1)×2]" (NO at Step S311), the routine proceeds to Step S313.

At Step S313, the controller 18 assigns a sum of the page number K and the constant NT to a page number H.

Next at Step S315, the controller 18 controls the image forming section 13 to form an image corresponding to the page number H on a sheet P and controls the guide member 7 to discharge the sheet P onto the third tray 63.

Then at Step S317, the controller 18 increments the page number M by one, and the routine then returns to Step S305.

As described above with reference to FIGS. 4 to 10, the controller 18 changes the discharge destination tray TR such that the sheets P are stacked on the first through third trays 61 to 63 in the order of the page numbers in the embodiment of the present disclosure. Therefore, the sheets P can be stacked on the first through third trays 61 to 63 in the order of the page numbers.

Also, every time the discharging roller pair 15 discharges a sheet P, the controller 18 changes the discharge destination tray TR. Therefore, just discharged sheets P having a high temperature are prevented from being stacked on one another. As a result, adhesion of the sheets P to one another can be inhibited more effectively.

Although the controller 18 changes the discharge destination tray TR to the first tray 61, the second tray 62, and the third tray 63 in the stated order in the embodiment of the present disclosure, the present disclosure is not limited to this configuration. It is only required that the controller 18 change the discharge destination tray TR every time the discharging roller pair 15 discharges a sheet P. The controller 18 may change the discharge destination tray TR to the third tray 63, the second tray 62, and the first tray 61 in the stated order, for example.

Figure 11:
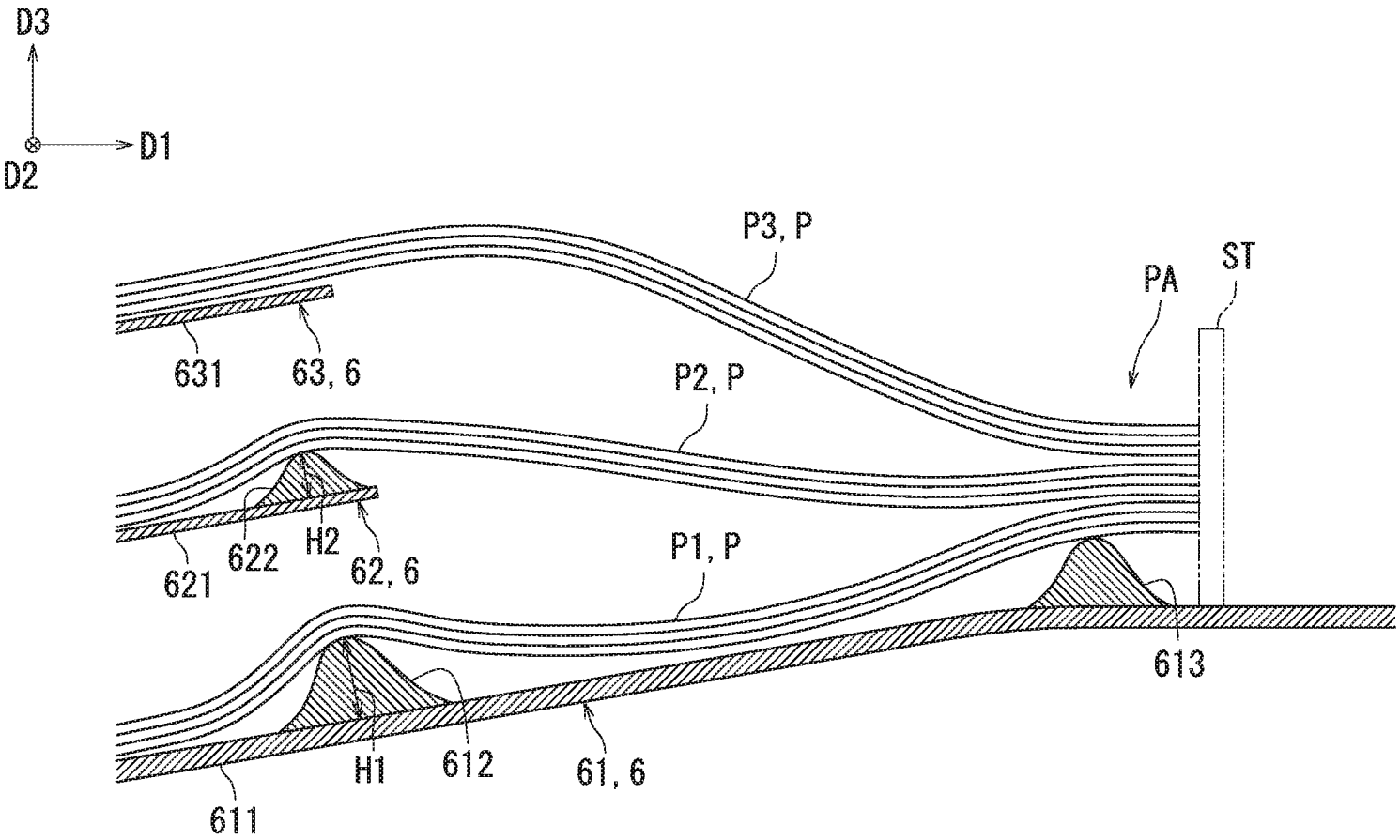
FIG. 11 is a side view illustrating examples of first protrusions and a second protrusion.

The following further describes the configuration of the sorting device 200 with reference to FIGS. 1 to 3 and 11. FIG. 11 is a side view illustrating examples of first protrusions 612 and 622 and a second protrusion 613. As illustrated in FIG. 11, the first tray 61 further includes the first protrusion 612 and the second protrusion 613. Also, the second tray 62 further includes the first protrusion 622.

As described with reference to FIG. 3, the length L2 of the second tray body 621 in the discharge direction D1 and the length L3 of the third tray body 631 in the discharge direction D1 are shorter than the length LP of each sheet P in the discharge direction D1. Accordingly, as illustrated in FIG. 11, leading ends PA of sheets P2 placed on the second tray 62 and leading ends PA of sheets P3 placed on the third tray 63 fall downwards to be located above the first tray 61.

The first protrusion 622 causes the sheets P2 placed on the second tray 62 to curve so that the leading ends PA of the sheets P are aligned. Specifically, the first protrusion 622 causes the sheets P2 to curve so that the position of the leading ends PA of the sheets P2 substantially coincides with that of the leading ends PA of the sheets P3.

More specifically, the first protrusion 622 protrudes from the upper surface of the second tray body 621 in the direction D3. The first protrusion 622 extends in the direction D2. The first protrusion 622 is located at an end of the second tray body 621 in the discharge direction D1. The first protrusion 622 has an upper surface substantially forming an arc. An end of the first protrusion 622 in the direction opposite to the discharge direction D1 is joined to the upper surface of the second tray body 621 such that the joint gives a smooth surface. The first protrusion 622 has a height H2 in the direction D3.

The first protrusion 612 causes sheets P1 placed on the first tray 61 to curve so that the leading ends PA of the sheets P are aligned. Specifically, the first protrusion 612 causes the sheets P1 to curve so that the position of leading ends PA of the sheets P1 substantially coincides with that of the leading ends PA of the sheets P3.

More specifically, the first protrusion 612 protrudes from the upper surface of the first tray body 611 in the direction D3. The first protrusion 612 extends in the direction D2. The first protrusion 612 is provided on the first tray body 611 so as to be located under the first protrusion 622. The first protrusion 612 has an upper surface substantially forming an arc. An end of the first protrusion 612 in the direction opposite to the discharge direction D1 is joined to the upper surface of the first tray body 611 such that the joint gives a smooth surface. The first protrusion 612 has a height H1 in the direction D3. The height H1 is higher than the height H2.

The second protrusion 613 is provided on the upper surface of the first tray body 611. The second protrusion 613 causes the sheets P (sheets P1 to P3) to curve so that the leading ends PA of the respective sheets P are spaced from the first tray body 611. Specifically, the second protrusion 613 causes the sheets P1 to P3 to curve so that the leading ends PA of the sheets P1, the leading ends PA of the sheets P2, and the leading ends PA of the sheets P3 are spaced from the first tray body 611.

More specifically, the second protrusion 613 is spaced from the position of leading edges of the sheets P by a specific distance in the direction opposite to the discharge direction D1. The second protrusion 613 protrudes from the upper surface of the first tray body 611 in the direction D3. The second protrusion 613 extends in the direction D2. The second protrusion 613 has an upper surface substantially forming an arc. An end of the second protrusion 613 in the direction opposite to the discharge direction D1 is joined to the upper surface of the first tray body 611 such that the joint gives a smooth surface.

As described above with reference to FIGS. 1 to 3 and 11, the first protrusion 612 causes the sheets P1 placed on the first tray 61 to curve so that the leading ends PA of the sheets P (sheets P1 to P3) are aligned in the embodiment of the present disclosure. The first protrusion 622 causes the sheets P2 placed on the second tray 62 to curve so that the leading ends PA of the sheets P are aligned. As a result, the leading ends PA of the sheets P can be aligned. Therefore, the sheets P stacked on the first through third trays 61 to 63 can be more easily collected.

Further, the second protrusion 613 causes the sheets P (sheets P1 to P3) to curve so that the leading ends PA of the sheets P are spaced from the first tray body 611. As a result, the leading ends PA of the sheets P are spaced from the first tray body 611. Therefore, the sheets P stacked on the first through third trays 61 to 63 can be more easily collected.

Although the first protrusions 612 and 622 align the leading ends PA of the sheets P1, the leading ends PA of the sheets P2, and the leading ends PA of the sheets P3 with one another in the embodiment of the present disclosure, the present disclosure is not limited to this configuration. For example, a stopper ST may align the leading ends PA of the sheets P1, the leading ends PA of the sheets P2, and the leading ends PA of the sheets P3 with one another.

Specifically, the stopper ST restricts the position of the leading ends PA of the sheets P2 and the position of the leading ends PA of the sheets P1 so that the positions of the respective leading ends PA coincide with the position of the leading ends PA of the sheets P3. The stopper ST is a plate-like member standing on the first tray body 611. The stopper ST extends in the direction D2.

The following further describes the second tray 62 and the third tray 63 with reference to FIGS. 1 to 3 and 11 to 13. FIG. 12A is a plan view of the second tray 62. FIG. 12B is a plan view of the third tray 63. As illustrated in FIG. 12A, the second tray 62 further includes a pivot shaft 624 and a pivotable member 623. As illustrated in FIG. 12B, the third tray 63 further includes a pivot shaft 634 and a pivotable member 633.

The pivotable member 623 is pivotably supported by the pivot shaft 624. The pivotable member 623 is a rectangular plate-like member. The pivot shaft 624 pivotably supports the pivotable member 623. The pivot shaft 624 extends in the direction D2.

Figure 12A:
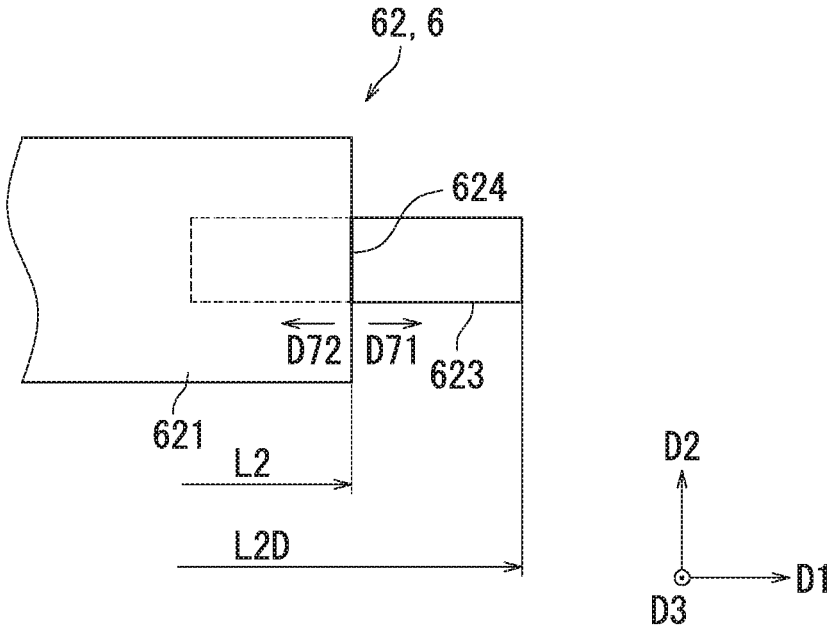
FIG. 12A is a plan view of a second tray.

The pivotable member 623 is pivotable between a state in which the pivotable member 623 is accommodated in the second tray body 621 as illustrated with broken lines in FIG. 12A and a state in which the pivotable member 623 projects from the end of the second tray body 621 in the discharge direction D1 as illustrated with solid lines in FIG. 12A. When the pivotable member 623 is caused to pivot in a direction D71, the pivotable member 623 shifts from the state in which the pivotable member 623 is accommodated in the second tray body 621 to the state in which the pivotable member 623 projects from the end of the second tray body 621 in the discharge direction D1. When the pivotable member 623 is caused to pivot in a direction D72, the pivotable member 623 shifts from the state in which the pivotable member 623 projects from the end of the second tray body 621 in the discharge direction D1 to the state in which the pivotable member 623 is accommodated in the second tray body 621.

In the state in which the pivotable member 623 is accommodated in the second tray body 621, the length L2 of the second tray 62 is shorter than the length LP as described with reference to FIG. 3. In the state in which the pivotable member 623 projects from the end of the second tray body 621 in the discharge direction D1, the second tray 62 has a length L2D that is longer than the length LP. The length L2D indicates the length of the second tray 62 in the discharge direction D1 in the state in which the pivotable member 623 projects from the end of the second tray body 621 in the discharge direction D1.

As described above, the second tray 62 is configured such that its length is adjustable. That is, in the state in which the pivotable member 623 is accommodated in the second tray body 621, the length L2 of the second tray 62 in the discharge direction D1 is shorter than the length LP. In the state in which the pivotable member 623 projects from the end of the second tray body 621 in the discharge direction D1, the length L2D of the second tray 62 in the discharge direction D1 is longer than the length LP.

The pivotable member 633 is pivotably supported by the pivot shaft 634. The pivotable member 633 is a rectangular plate-like member. The pivot shaft 634 pivotably supports the pivotable member 633. The pivot shaft 634 extends in the direction D2.

Figure 12B:
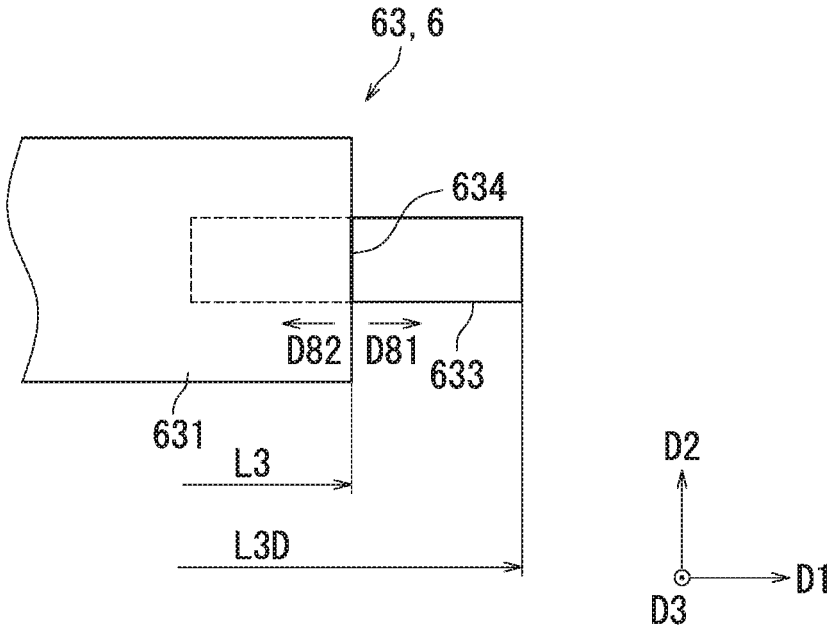
FIG. 12B is a plan view of a third tray.

The pivotable member 633 is pivotable between a state in which the pivotable member 633 is accommodated in the third tray body 631 as illustrated with broken lines in FIG. 12B and a state in which the pivotable member 633 projects from an end of the third tray body 631 in the discharge direction D1 as illustrated with solid lines in FIG. 12B. When the pivotable member 633 is caused to pivot in a direction D81, the pivotable member 633 shifts from the state in which the pivotable member 633 is accommodated in the third tray body 631 to the state in which the pivotable member 633 projects from the end of the third tray body 631 in the discharge direction D1. When the pivotable member 633 is caused to pivot in a direction D82, the pivotable member 633 shifts from the state in which the pivotable member 633 projects from the end of the third tray body 631 in the discharge direction D1 to the state in which the pivotable member 633 is accommodated in the third tray body 631.

In the state in which the pivotable member 633 is accommodated in the third tray body 631, the length L3 of the third tray 63 is shorter than the length LP as described with reference to FIG. 3. In the state in which the pivotable member 633 projects from the end of the third tray body 631 in the discharge direction D1, the third tray 63 has a length L3D that is longer than the length LP. The length L3D indicates the length of the third tray 63 in the discharge direction D1 in the state in which the pivotable member 633 projects from the end of the third tray body 631 in the discharge direction D1.

As described above, the third tray 63 is configured such that its length is adjustable. That is, in the state in which the pivotable member 633 is accommodated in the third tray body 631, the length L3 of the third tray 63 in the discharge direction D1 is shorter than the length LP. In the state in which the pivotable member 633 projects from the end of the third tray body 631 in the discharge direction D1, the length L3D of the third tray 63 in the discharge direction D1 is longer than the length LP.

Figure 13:
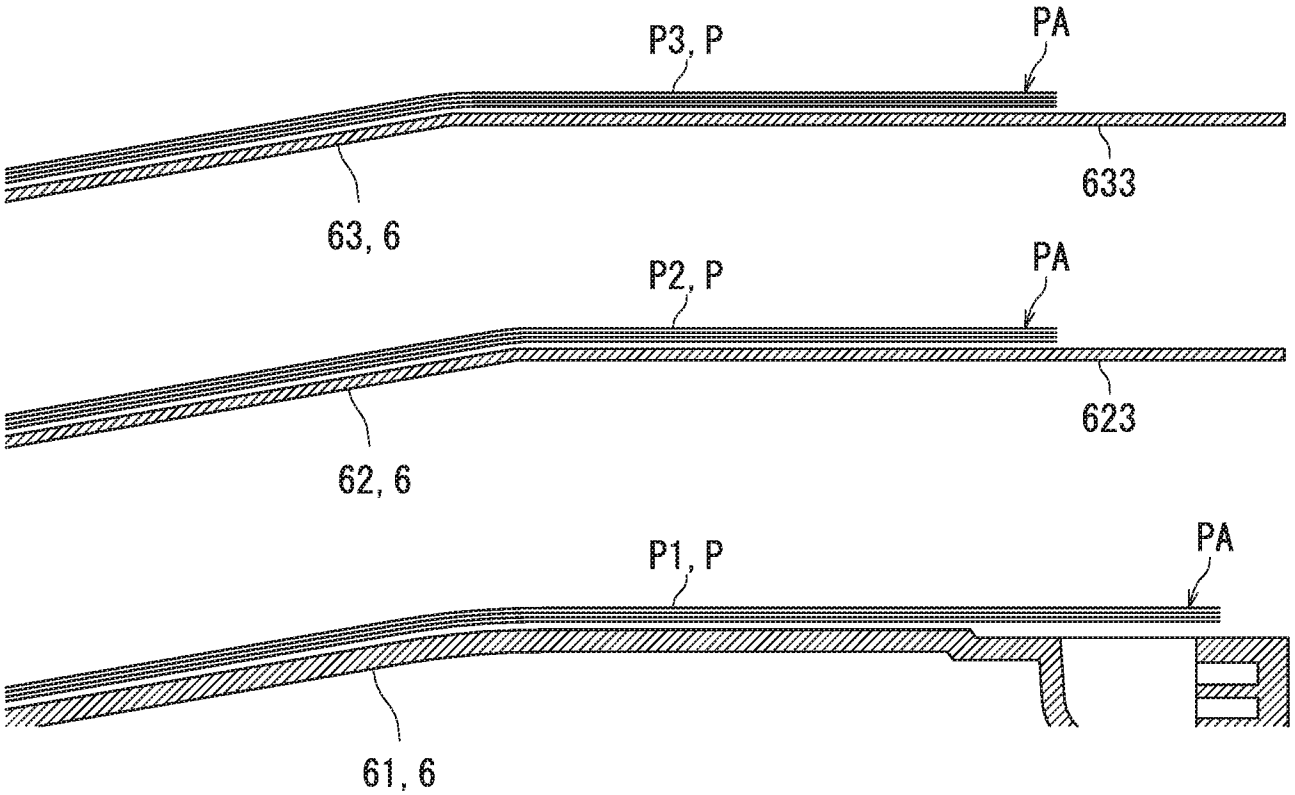
FIG. 13 is a side view illustrating an example of a state in which the second tray and the third tray are extended.

FIG. 13 is a side view illustrating an example of a state in which the second tray 62 and the third tray 63 are extended. As illustrated in FIG. 13, in the state in which the second tray 62 and the third tray 63 are extended, the sheets P2 are stacked on the second tray 62 and the sheets P3 are stacked on the third tray 63.

That is, in the state in which the second tray 62 is extended (i.e., the pivotable member 623 projects from the end of the second tray body 621 in the discharge direction D1), the length L2D of the second tray 62 in the discharge direction D1 is longer than the length LP. Accordingly, the sheets P2 can be stacked on the second tray 62.

Also, in the state in which the third tray 63 is extended (i.e., the pivotable member 633 projects from the end of the third tray body 631 in the discharge direction D1), the length L3D of the third tray 63 in the discharge direction D1 is longer than the length LP. Accordingly, the sheets P3 can be stacked on the third tray 63.

As described above with reference to FIGS. 1 to 3 and 11 to 13, the lengths of the second tray 62 and the third tray 63 in the discharge direction D1 are adjustable in the embodiment of the present disclosure. In this configuration, the second tray 62 can be extended in the discharge direction D1 to support the leading ends PA of the sheets P2. Also, the third tray 63 can be extended in the discharge direction D1 to support the leading ends PA of the sheets P3. Through the above, the sheets P2 can be stacked on the second tray 62 and the sheets P3 can be stacked on the third tray 63.

Although the lengths of the second tray 62 and the third tray 63 in the discharge direction D1 are adjustable in the embodiment of the present disclosure, the present disclosure is not limited to this configuration. It is only required that at least one of the length of the second tray 62 in the discharge direction D1 and the length of the third tray 63 in the discharge direction D1 be adjustable.

Through the above, the embodiment of the present disclosure has been described with reference to the drawings. However, the present disclosure is not limited to the above embodiment and may be practiced in various manners within a scope not departing from the gist of the present disclosure (for example, as described below in (1) to (3)). The drawings schematically illustrate elements of configuration to facilitate understanding thereof. Properties of the elements of configuration, such as thickness and length, and the number of each element may differ from actual ones thereof to facilitate preparation of the drawings. Also, shape, dimensions, and the like of elements of configuration described in the above embodiment are merely examples and not intended as specific limitations. Various alterations may be made within a scope not substantially departing from the configuration of the present disclosure.

(1) As described with reference to FIG. 1, the image forming apparatus 100 is a printer, which however should not be taken to limit the present disclosure. It is only required that the image forming apparatus 100 include the image forming section 13. For example, the image forming apparatus may be a multifunction peripheral. Alternatively, the image forming apparatus may be a copier.

(2) As described with reference to FIGS. 1 to 3, the image forming apparatus 100 includes the first through third trays 61 to 63, which however should not be taken to limit the present disclosure. It is only required that the image forming apparatus 100 include a plurality of trays. For example, the number of trays included in the image forming apparatus 100 may be two or more than three. As the number of trays increases, a period from when a sheet P is discharged onto one of the trays to when another sheet P is discharged onto the same tray becomes longer. As a result, the sheets P can be cooled effectively.

(3) As described with reference to FIGS. 1 to 3 and 11, the first through third trays 61 to 63 are configured such that the leading ends PA of the sheets P are aligned, which however should not be taken to limit the present disclosure. It is only required that the first through third trays 61 to 63 be configured such that the respective leading ends PA of the sheets P1 to P3 are superposed on one another. That is, the first protrusion 612 of the first tray 61 and the first protrusion 622 of the second tray 62 may be omitted. In this configuration, the leading ends PA of the sheets P2 and P3 fall downwards to be located on the sheets P1 placed on the first tray body 611 and the respective leading ends PA of the sheets P1 to P3 are superposed on one another.

What is claimed is:

1. An image forming apparatus comprising:

an image forming section configured to form an image on each of a plurality of recording mediums;

a discharge device configured to discharge each of the recording mediums;

a plurality of trays on which the recording mediums discharged by the discharge device are to be stacked;

at least one guide member configured to guide each of the recording mediums from the discharge device toward a discharge destination tray among the plurality of trays, the discharge destination tray being a tray onto which the recording medium guided by the at least one guide member is to be discharged; and a controller, wherein every time one of the recording mediums is discharged by the discharge device, the controller controls the at least one guide member to change the discharge destination tray, the trays are configured such that leading ends of the recording mediums in a discharge direction are superposed on one another, at least one of the trays has a length in the discharge direction that is shorter than a length of each of the recording mediums in the discharge direction, the at least one guide member includes a plate-like member and a support member pivotably supporting the plate-like member, the plate-like member includes a projection at an end of the plate-like member in the discharge direction, the projection projecting in the discharge direction, the at least one tray includes a recess at an end of the at least one tray in a direction opposite to the discharge direction, the recess being an indented space in the discharge direction, and the plate-like member pivots in a manner that the projection passes through the recess.

2. The image forming apparatus according to claim 1, wherein the length of the at least one tray is adjustable in the discharge direction.

3. The image forming apparatus according to claim 1, wherein the at least one guide member includes a first guide member that guides a lower surface of each of the recording mediums and a second guide member that guides an upper surface of each of the recording mediums.

4. The image forming apparatus according to claim 1, wherein the controller gives a page number to each of the recording mediums, and the controller controls the at least one guide member to change the discharge destination tray such that the recording mediums are stacked on the trays in an order of the page numbers.

5. The image forming apparatus according to claim 1, wherein every time one of the recording mediums is discharged by the discharge device, the controller controls the at least one guide member to change the discharge destination tray.

6. The image forming apparatus according to claim 1, wherein at least one of the trays includes a protrusion that causes a recording medium placed on the at least one tray to curve so that the leading ends of the recording mediums in the discharge direction are aligned, and the protrusion extends in a direction perpendicular to the discharge direction and a vertical direction.

7. The image forming apparatus according to claim 1, further comprising a stopper configured to restrict a position of the leading end of each of the recording mediums in the discharge direction so that the leading ends of the recording mediums are aligned.

8. The image forming apparatus according to claim 1, wherein a lowermost tray among the plurality of trays includes a protrusion that causes the recording mediums to curve so that the leading end of each of the recording mediums in the discharge direction is spaced from the lowermost tray, and the protrusion extends in a direction perpendicular to the discharge direction and a vertical direction.

* * * * *